US011248398B2

(12) United States Patent
Sullivan

(10) Patent No.: US 11,248,398 B2
(45) Date of Patent: Feb. 15, 2022

(54) PATCH LOCK ASSEMBLY

(71) Applicant: Hanchett Entry Systems, Inc., Phoenix, AZ (US)

(72) Inventor: Scott P. Sullivan, Peoria, AZ (US)

(73) Assignee: Hanchett Entry Systems, Inc., Phoenix, AZ (US)

( * ) Notice: Subject to any disclaimer, the term of this patent is extended or adjusted under 35 U.S.C. 154(b) by 439 days.

(21) Appl. No.: 16/254,052

(22) Filed: Jan. 22, 2019

(65) Prior Publication Data

US 2019/0226240 A1 Jul. 25, 2019

Related U.S. Application Data

(60) Provisional application No. 62/620,791, filed on Jan. 23, 2018.

(51) Int. Cl.

| | |
|---|---|
| ***E05B 65/00*** | (2006.01) |
| ***E05B 9/08*** | (2006.01) |
| ***E05B 55/00*** | (2006.01) |
| ***E05B 63/12*** | (2006.01) |
| ***E05B 63/00*** | (2006.01) |

(Continued)

(52) U.S. Cl.

CPC ..... *E05B 65/0025* (2013.01); *E05B 9/08* (2013.01); *E05B 15/02* (2013.01); *E05B 55/00* (2013.01); *E05B 55/005* (2013.01); *E05B 63/0056* (2013.01); *E05B 63/08* (2013.01); *E05B 63/12* (2013.01); *E05B 19/0041* (2013.01); *E05B 47/0047* (2013.01); *E05B 65/10* (2013.01);

(Continued)

(58) Field of Classification Search

CPC . E05B 9/002; E05B 9/08; E05B 9/082; E05B 9/084; E05B 15/02; E05B 15/0205; E05B 17/06; E05B 19/0041; E05B 47/0047; E05B 2047/0057; E05B 2047/0058; E05B 55/00; E05B 55/005; E05B 57/00; E05B 63/0052; E05B 63/0056; E05B 63/08; E05B 63/12; E05B 65/0025; E05B 65/10; E05C 7/04

See application file for complete search history.

(56) References Cited

U.S. PATENT DOCUMENTS 2,952,150 A * 9/1960 Matzkin ..... E05B 65/0025 70/451
4,456,290 A * 6/1984 Gross ..... E05B 65/0025 292/337

(Continued)

*Primary Examiner* — Christopher J Boswell

(57) ABSTRACT

A patch lock assembly releasably secures a glass door to an adjacent glass panel in a locked orientation. The patch lock assembly comprises a latch adapter housing, a strike adapter housing, and first and second power supply adapter housings. The latch adapter housing may interchangeably receive one of any number of various latch mechanisms without requiring further modification of the door. The strike adapter housing may interchangeably receive one of any number of various strikes, including electric strikes, without requiring further modification of the door. Respective power supply adapter housings may be coupled to each latch adapter housing and strike adapter housing. The power supply adapters include a power source and control unit to provide the necessary power to operate the latch and strike. Various interlocking features may be incorporated in the design to resist unwanted movement of the patch lock assembly relative to the glass panel.

15 Claims, 16 Drawing Sheets

(51) Int. Cl.

| | |
|---|---|
| ***E05B 15/02*** | (2006.01) |
| ***E05B 63/08*** | (2006.01) |
| *E05B 19/00* | (2006.01) |
| *E05B 65/10* | (2006.01) |
| *E05B 47/00* | (2006.01) |
| *E05C 7/04* | (2006.01) |

(52) U.S. Cl.
CPC ..... *E05B 2047/0057* (2013.01); *E05B 2047/0058* (2013.01); *E05C 7/04* (2013.01)

(56) References Cited

U.S. PATENT DOCUMENTS

| | | | | |
|---|---|---|---|---|
| 7,475,925 | B2 * | 1/2009 | Huang | E05B 15/02 292/347 |
| 8,161,779 | B2 * | 4/2012 | Bergmann | E05B 65/0025 70/97 |
| 8,534,099 | B2 * | 9/2013 | Wheeler | E05B 15/102 70/100 |
| 9,309,696 | B2 * | 4/2016 | Friese | E05B 65/087 |
| 10,415,267 | B1 * | 9/2019 | Schmutz | E05B 9/002 |
| 10,767,392 | B2 * | 9/2020 | Aguirrezabala Olasagasti | E05B 63/006 |
| 2006/0232080 | A1 * | 10/2006 | Washington | E05B 65/025 292/337 |
| 2016/0194899 | A1 * | 7/2016 | Aykas | E05B 15/024 292/341.15 |

* cited by examiner

PATCH LOCK ASSEMBLY

RELATIONSHIP TO OTHER APPLICATIONS AND PATENTS

The present application claims the benefit of U.S. Provisional Patent Application No. 62/620,791, filed Jan. 23, 2018, which is hereby incorporated by reference in its entirety.

TECHNICAL FIELD

The present invention relates to exit devices for latching a hinged door; more particularly, to a patch lock assembly for use with glass panel doors, and still more particularly to a patch lock assembly for use with glass panel doors where an adapter housing of the patch lock assembly is firmly secured to the glass panel door by one or more interlocking features and may be selectively modified so as to receive one of a plurality of different door latches, door latch actuators and electronic components. The patch lock assembly may be configured as a patch latch assembly or as a patch strike assembly for use with adjacent glass panels.

BACKGROUND OF THE INVENTION

Mounting door lock components, such as latches and strikes, upon glass panel doors presents a number of challenges. Typically, when mounting a latch or a strike plate to a glass door, the approach is to cut a patch or recess within the glass panel whereby a two-piece latch or strike unit having a matching profile is inserted within the patch. Unit flanges sandwich a portion of the glass panel such that the unit may be secured to the panel through a clamping force exerted on the glass panel. However, heretofore, each door latch or strike would require a unique patch to be formed within the glass panel and, since exerted clamping force provided the primary means of securing the latch or strike unit to the glass panel, a secure retention of the latch/strike to the glass panel was compromised.

Thus, what is needed in the art is a patch lock assembly for use with glass panel doors whereby one or more interlocking retention features may be utilized to resist unwanted loosening of the patch assembly from the glass panel.

What is further needed in the art is a patch lock assembly for use with glass panel doors whereby a standardized patch may be formed within the glass panel such that a patch lock assembly may be secured to the door and operably receive one of numerous different latches or strikes.

What is further needed in the art is a combined patch strike assembly and patch latch assembly for use with a double glass door installation, or a glass door to glass panel installation, whereby one or more interlocking retention features may be utilized to resist unwanted loosening of the patch assemblies from the respective glass panels.

What is still further needed in the art is a patch lock assembly for use with glass panel doors that include an adjacent patch assembly configured as either a power supply module or a control module.

It is a principal object of the present invention to address these, as well as other, needs.

SUMMARY OF THE INVENTION

Briefly described, one aspect of the invention may be directed to a patch lock assembly for use in a door latch system, the patch lock assembly being securable to a door, the patch lock assembly comprising an adapter housing having a first adapter subunit and a second adapter subunit wherein when the patch lock assembly is secured to the door, the first adapter subunit is disposed on a first surface of the door and the second adapter unit is disposed on a second surface of the door opposite the first surface. Further, at least one interlocking feature is configured to inhibit translation of the patch lock assembly relative to the door in any one of an x, y or z direction.

The interlocking feature may be a first notch defined by the recess, wherein the first adapter subunit is connected to the second adapter subunit by a first fastener to secure the patch lock assembly to the door, and wherein the first fastener interferes with the first notch defined by the recess to inhibit translation of the patch lock assembly relative to the door in an x direction.

The interlocking feature may further include a second notch defined by the recess, wherein the patch lock assembly includes a second fastener to secure the patch lock assembly to the door, and wherein the first and second fasteners interfere with respective first and second notches to inhibit translation of the patch lock assembly relative to the door in an x direction.

A further aspect of the present invention may be directed to a patch lock assembly for releasably securing a door to an adjacent glass panel in a locked orientation. The patch lock assembly comprises a latch adapter housing, a strike adapter housing, a first power supply adapter housing and a second power supply adapter housing.

The latch adapter housing includes a first latch adapter subunit having an outer face, an inner face and a top sidewall, back sidewall and bottom sidewall extending perpendicularly outward from the inner face, each sidewall being configured to engage an interior surface of the first door. A second latch adapter subunit has an outer face, an inner face and a top sidewall, back sidewall and bottom sidewall extending perpendicularly outward from the inner face, each sidewall being configured to engage an exterior surface of the first door. The first latch adapter subunit and second latch adapter subunit are each configured to bound a first portion of a recess defined within the first door to thereby define a door latch receiving cavity therebetween. The door latch receiving cavity is configured to coincide with an edge of door. The top and bottom sidewalls of the first and second latch adapter subunits further include respective sidewall mating surfaces extending perpendicularly outward from each respective inner face. The respective sidewall mating surfaces have complementary locking stepped profiles configured to engage one another when the first latch adapter subunit and second latch adapter subunit are mounted on the door.

The strike adapter housing includes a first strike adapter subunit having an outer face, an inner face and a top sidewall, front sidewall, back sidewall and bottom sidewall extending perpendicularly outward from the inner face, the top sidewall, back sidewall and bottom sidewall each being configured to engage an interior surface of the glass panel. A second strike adapter subunit has an outer face, an inner face and a top sidewall, front sidewall, back sidewall and bottom sidewall extending perpendicularly outward from the inner face, the top sidewall, back sidewall and bottom sidewall each being configured to engage an exterior surface of the glass panel. The first strike adapter subunit and second strike adapter subunit are each configured to bound a first portion of a recess defined within the glass panel. The door strike receiving cavity is configured to coincide with an edge of the glass panel opposite the door latch receiving cavity.

The first power supply adapter housing is coupled adjacent to the latch adapter housing. The power supply adapter housing includes a first power supply adapter subunit having an outer face, an inner face and a top sidewall, back sidewall and bottom sidewall extending perpendicularly outward from the inner face. A second power supply adapter subunit has an outer face, an inner face and a top sidewall, back sidewall and bottom sidewall extending perpendicularly outward from the inner face. The first power supply adapter subunit and second power adapter subunit are each configured to bound a second portion of the recess defined within the door to thereby define a power supply receiving cavity therebetween configured to receive a power supply and control unit.

The second power supply adapter housing is coupled adjacent to the strike housing wherein the first power supply adapter subunit and second power adapter subunit are each configured to bound a second portion of the recess defined within the glass panel to thereby define a power supply receiving cavity therebetween configured to receive a power supply and control unit.

A further aspect of the present invention is directed to a patch latch assembly for use in a door latch system. The door latch system releasably secures a door in a locked orientation and defines a recess configured to receive the patch latch assembly. The door latch system is selectively moveable from a latched position whereby the door is secured in the locked orientation to an unlatched position whereby the door is in an unlocked orientation and is free to open. The patch latch assembly comprises a latch adapter housing and first and second fasteners.

The latch adapter housing includes a first latch adapter subunit having an outer face, an inner face and a top sidewall, back sidewall and bottom sidewall extending perpendicularly outward from the inner face. Each sidewall is configured to engage an interior surface of the door when the first latch adapter subunit is mounted on the door. A second latch adapter subunit has an outer face, an inner face and a top sidewall, back sidewall and bottom sidewall extending perpendicularly outward from the inner face. Each sidewall is configured to engage an exterior surface of the door when the second latch adapter subunit is mounted on the door. The first latch adapter subunit and second latch adapter subunit each bound the recess to thereby define a door latch receiving cavity therebetween. The top and bottom sidewalls of the first and second latch adapter subunits further include respective sidewall mating surfaces extending perpendicularly outward from each respective inner face. The respective sidewall mating surfaces have complementary locking stepped profiles configured to engage one another when the first latch adapter subunit and second latch adapter subunit are mounted on the door. The first fastener secures the first latch adapter subunit to the second latch adapter subunit proximate a junction of the top sidewall and back sidewall. The second fastener secures the first latch adapter subunit to the second latch adapter subunit proximate a junction of the bottom sidewall and back sidewall.

A still further aspect of the present invention is directed to a patch strike assembly for releasably securing a door to an adjacent glass panel in a locked orientation. The patch lock assembly comprises a strike adapter housing and first and second fasteners. The strike adapter housing includes a first strike adapter subunit having an outer face, an inner face and a top sidewall, front sidewall, back sidewall and bottom sidewall extending perpendicularly outward from the inner face. The top sidewall, back sidewall and bottom sidewall are each configured to engage an interior surface of the glass panel. A second strike adapter subunit has an outer face, an inner face and a top sidewall, front sidewall, back sidewall and bottom sidewall extending perpendicularly outward from the inner face. The top sidewall, back sidewall and bottom sidewall are each configured to engage an exterior surface of the glass panel. The first strike adapter subunit and second strike adapter subunit are each configured to bound a first portion of a recess defined within the glass panel to define a door strike receiving cavity. The door strike receiving cavity is configured to coincide with an edge of the glass panel. The first fastener secures the first strike adapter subunit to the second strike adapter subunit proximate a junction of the top sidewall and back sidewall and the second strike fastener secures the first adapter subunit to the second strike adapter subunit proximate a junction of the bottom sidewall and back sidewall.

Numerous applications, some of which are exemplarily described below, may be implemented using the present invention.

BRIEF DESCRIPTION OF THE DRAWINGS

The present invention will now be described, by way of example, with reference to the accompanying drawings, in which.

Figure 1:
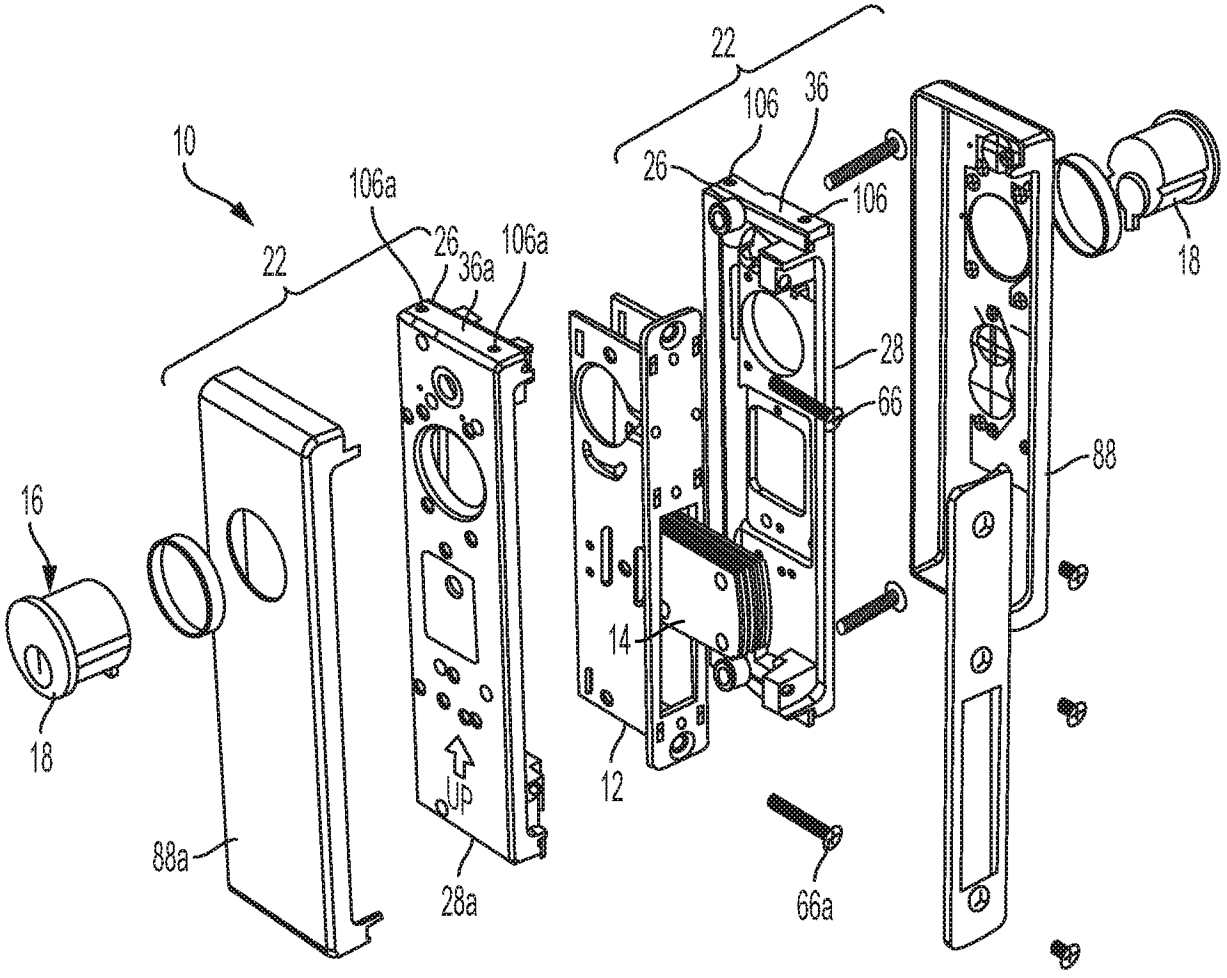
FIG. 1 is an exploded view of an embodiment of a door latch system with patch lock assembly shown as a patch latch assembly in accordance with the present invention.

Corresponding reference characters indicate corresponding parts throughout the several views. The exemplifications set out herein illustrate currently preferred embodiments of the present invention, and such exemplifications are not to be construed as limiting the scope of the invention in any manner.

DESCRIPTION OF THE PREFERRED EMBODIMENTS

Figure 2:
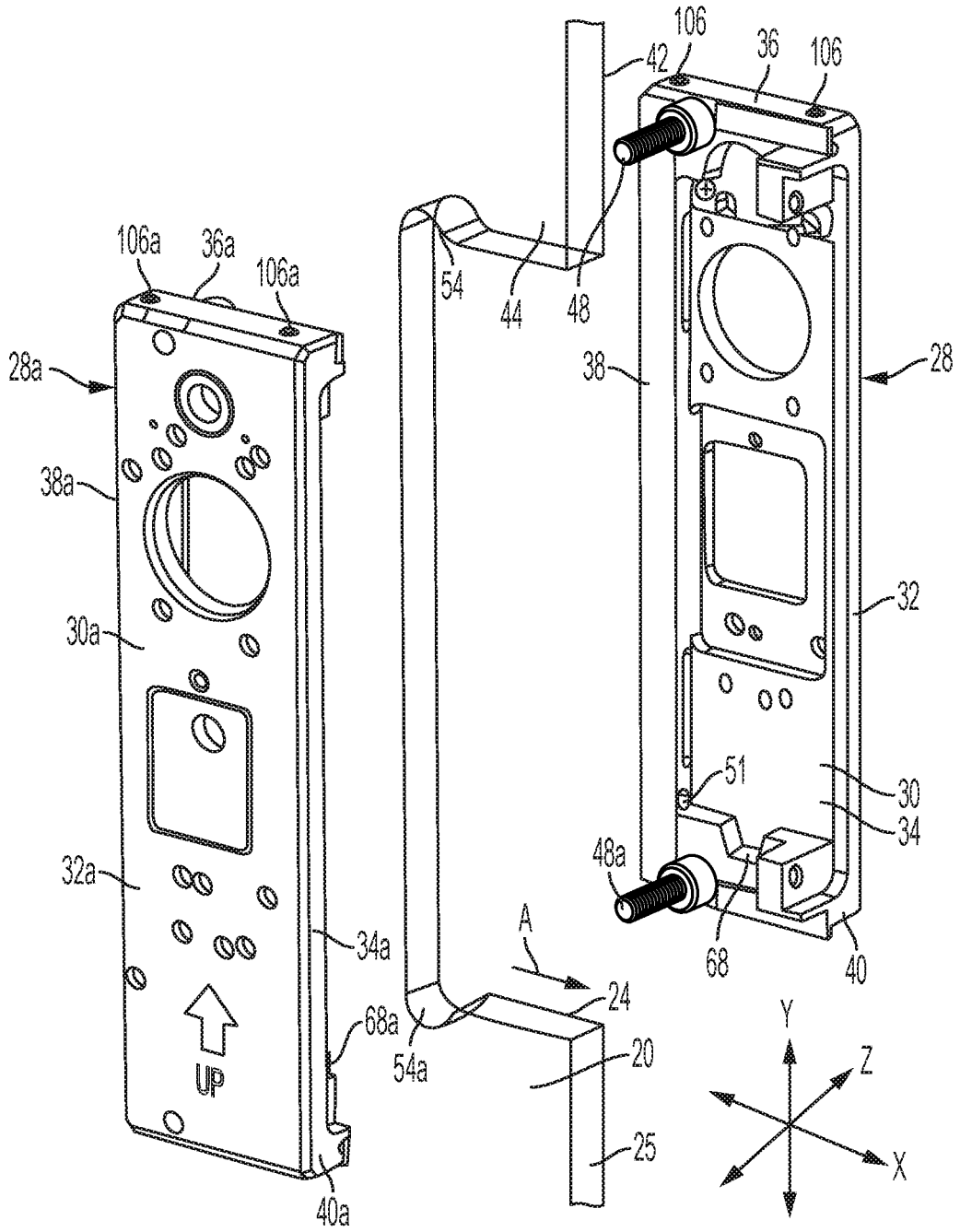
FIG. 2 is a perspective view of a patch latch adapter unit for use within the patch latch assembly shown in FIG. 1 shown from the door exterior.
Figure 3:
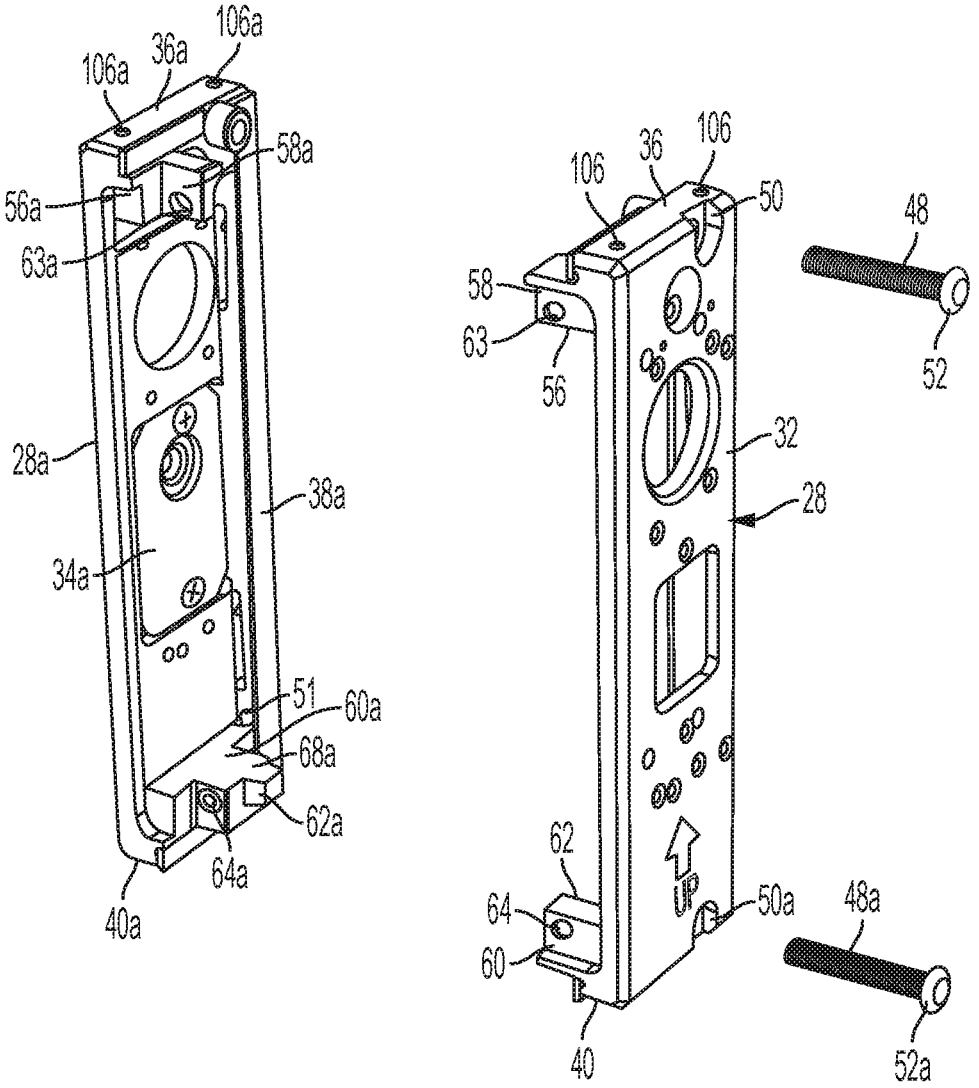
FIG. 3 is a perspective view of the patch latch adapter unit shown from the door interior.
Figure 4:
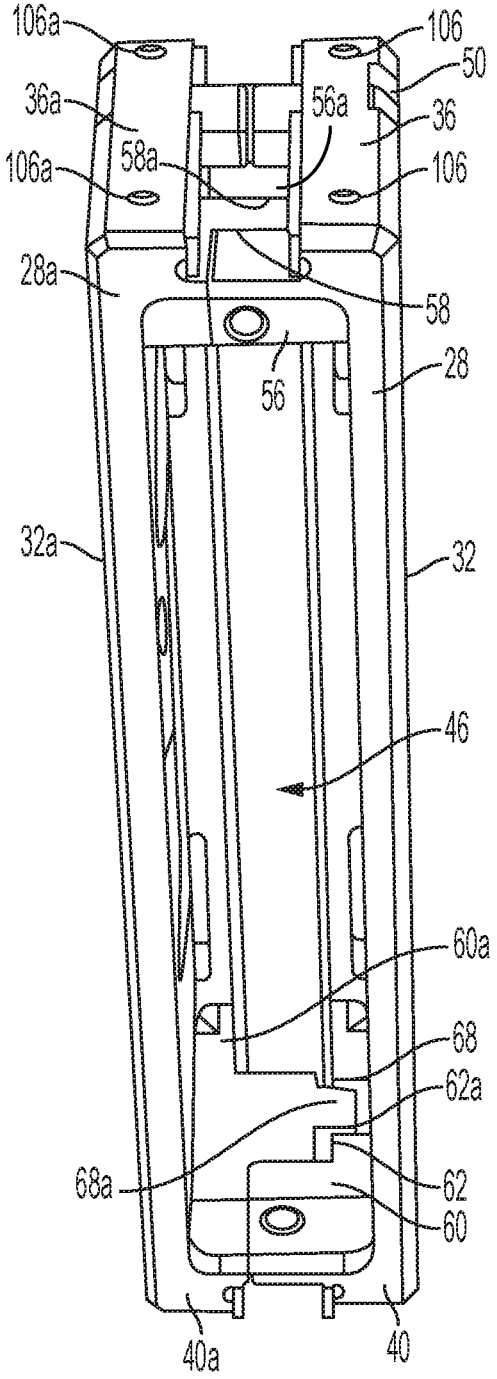
FIG. 4 is an end view of an assembled patch latch adapter unit.

Referring to FIGS. 1-4, door latch system 10 may generally include latch mechanism 12 having a latch 14 that may be configured to be actuated through an actuating mechanism 16, such as for example, a key- or hand-operated cylinder 18 (key-operated cylinder shown in FIG. 1) mounted on a door, such as glass panel door 20 (see FIG. 2). To effectuate mounting of latch mechanism 12 onto door 20, door latch system 10 may include a patch lock assembly such as patch latch assembly 22 configured to reside within a patch or recess 24 formed on the edge 25 of door 20.

Patch latch assembly 22 generally includes a latch adapter housing 26 comprised of opposing first and second latch adapter subunits 28, 28*a*. Each latch adapter subunit 28, 28*a* comprises a latch adapter plate 30, 30*a* having a respective outer face 32, 32*a* and a respective inner face 34, 34*a*. A respective top sidewall 36, 36*a*, back sidewall 38, 38*a* and bottom sidewall 40, 40*a* extend perpendicularly outward from respective inner face 34, 34*a*. Top sidewall 36, back sidewall 38 and bottom sidewall 40 of first latch adapter subunit 28 are proportioned to bound 3-sided recess 24 on a first surface 42 of door 20 while top sidewall 36*a*, back sidewall 38*a* and bottom sidewall 40*a* of second latch adapter subunit 28*a* are proportioned to bound 3-sided recess 24 on second surface 44 of door 20 (see FIG. 2) so as to define a door latch receiving cavity 46 therebetween (see e.g., FIG. 4) for receiving latch mechanism 12 therein. First and second latch adapter subunits 28, 28*a* may be secured to one another through a pair of fasteners, such as but no limited to screws 48, 48*a*. To that end, first latch adapter subunit 28 may include recesses 50, 50*a* configured to receive heads 52, 52*a* of screws 48, 48*a* such that outer face 32 maintains a flush surface.

In one aspect of the present invention, screw 48 is located proximate the corner created by top sidewall 36 and back sidewall 38 while screw 48*a* is located proximate the corner created by bottom sidewall 40 and back sidewall 38. With reference to FIG. 2, door 20 may further define notches 54, 54*a* formed in adjacent corners of recess 24. Notch 54 is positioned to coincide with screw 48 and notch 54*a* coincides with screw 48*a* when patch latch assembly 22 is mounted onto door 20. In this manner, notches 54, 54*a* provide an interference with screws 48, 48*a* should attempts be made to translate patch latch assembly 22 toward the open side of recess 24 along an x-axis as generally shown by arrow A in FIG. 2, such as through external attempts to remove, disable or destroy door latch system 10. As a result, movement of patch latch assembly 22 is restricted in all three ordinal directions, x, y, z, when mounted onto door 20.

To provide additional structural security to patch latch assembly 22, inner face 34, 34*a* of first and second latch adapter plates 30, 30*a* may further include respective sidewall projections 56, 56*a* having mating profiled surfaces 58, 58*a* proximate top sidewalls 36, 36 and respective sidewall projections 60, 60*a* having mating profiled surfaces 62, 62*a* proximate bottom sidewalls 40, 40*a*. When first and second latch adapter subunits 28, 28*a* are secured together via screws 48, 48*a* as described above, such as along the z-axis (FIG. 2), respective projections 56/56*a* and 60/60*a* matingly engage one another. Each projection defines a respective bore 63, 63*a*, 64, 64*a* such that paired bores 63/64 and 63*a*/64*a* align with one another. Aligned bores 63/64 and 63*a*/64*a* may then receive a respective mounting screw 66, 66*a* used to secure latch mechanism 12 to patch latch assembly 22 (see FIG. 1), such as along the x-axis (FIG. 2). As shown most clearly in FIGS. 2-4, projections 60, 60*a* may also include corresponding stepped profiles whereby a tongue 68*a* extending outwardly from projection 60*a* is matingly received within notch 68 defined in projection 60. In this manner, paired tongue 68*a*/notch 68 resist travel of one or both of first and second latch adapter subunits 28, 28*a* along the x-axis, such as through a shearing action due to unauthorized attempts to dislodge patch latch assembly 22 and door latch system 10 from door 20.

Thus, in accordance with the invention, one or more interlocking features may be incorporated into door latch system 10 to secure patch latch assembly 22 to glass panel door 20 including one or more of the following interlocking features:

- Notches 54, 54*a* to secure the patch latch assembly in the x direction;
- Fasteners 48, 48*a* to secure the patch latch assembly in the z direction;
- Opposing sides of recess 24 to secure the patch latch assembly in the y direction;
- Projections 56, 56*a*, 60, 60*a* to oppose relative movement of latch adapter subunits 28, 28*a* in the x direction;
- Tongue 68*a* and notch 68 to oppose relative movement of latch adapter subunits 28, 28*a*.

Figure 5:
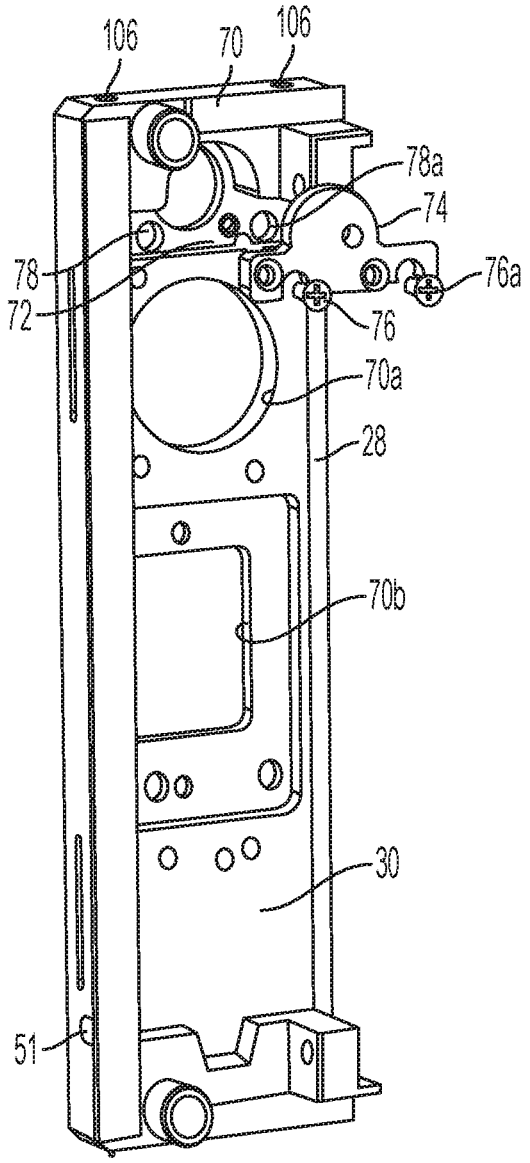
FIG. 5 is an interior view of the patch latch adapter unit including a first insert configuration in accordance with the present invention.
Figure 6:
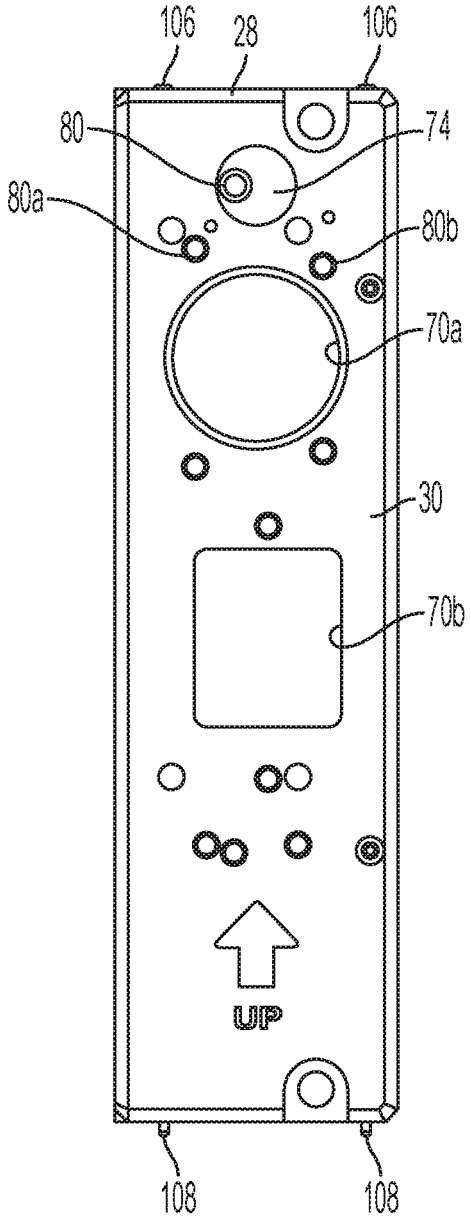
FIG. 6 is an exterior view of the patch latch adapter unit shown in FIG. 5.
Figure 7:
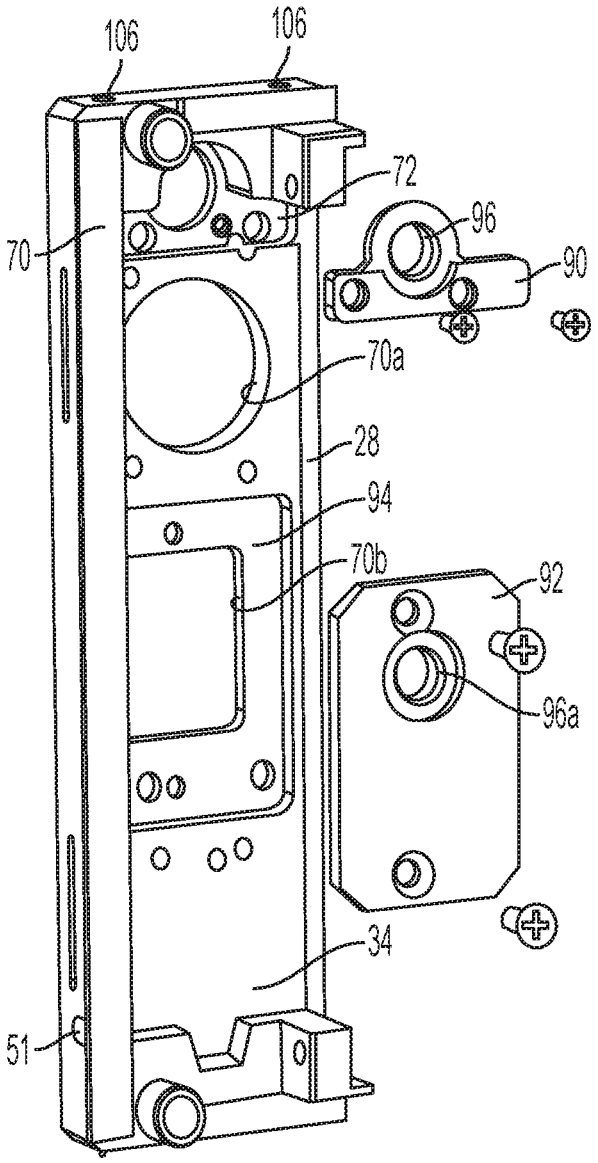
FIG. 7 is an interior view of the patch latch adapter unit including an alternative insert configuration in accordance with the present invention.

By way of example and as shown in FIGS. 5-8, patch latch assembly 22 may be selectively modified such that first and second latch adapter subunits 28, 28*a* may receive one of any number of door latch mechanisms and latch actuators (see examples shown in FIGS. 11-14). The below discussion of FIGS. 5-8 will reference modifications of first latch adapter subunit 28. It should be understood by those skilled in the art that similar modifications may be made to second latch adapter subunit 28*a* so as to accommodate a selected latch mechanism/actuator. Thus, as shown in FIGS. 5 and 7, first latch adapter subunit 28 may include a plurality of apertures, such as apertures 70, 70*a* and 70*b*.

Figure 12:
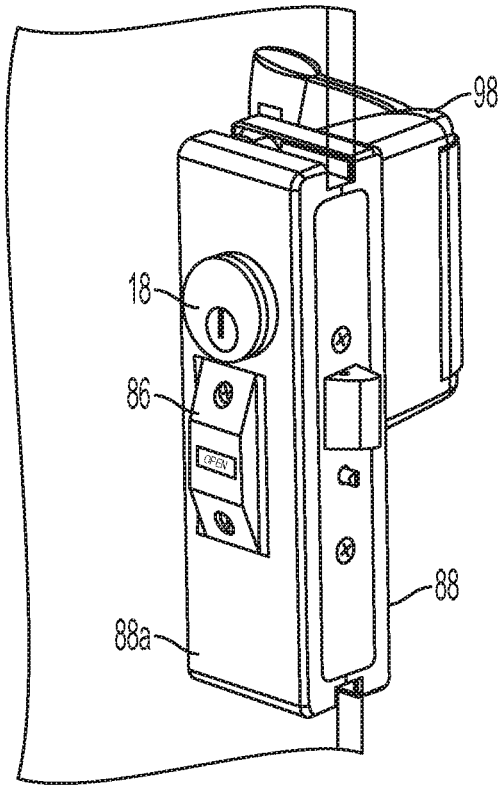
FIG. 12 is an exemplary embodiment of the door latch system with patch latch assembly including a lock cylinder, deadlatch paddle and exit notifier.
Figure 13:
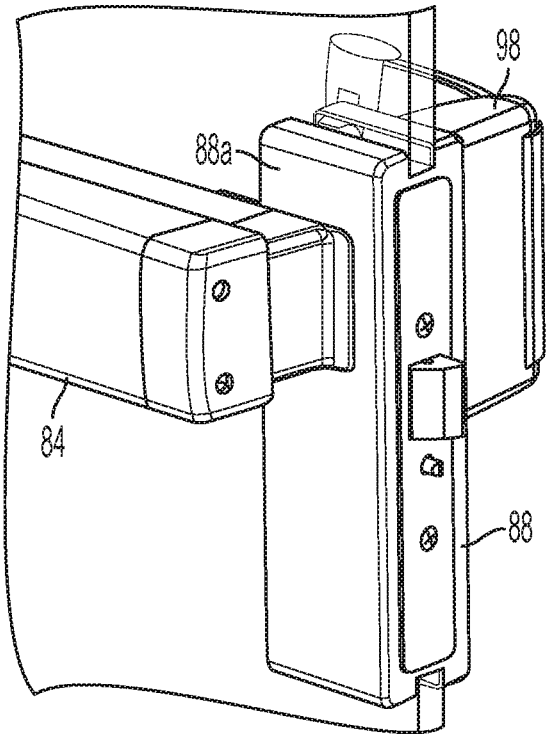
FIG. 13 is an exemplary embodiment of the door latch system with patch latch assembly including a push bar actuator and a latch paddle shown from the door exterior.
Figure 14:
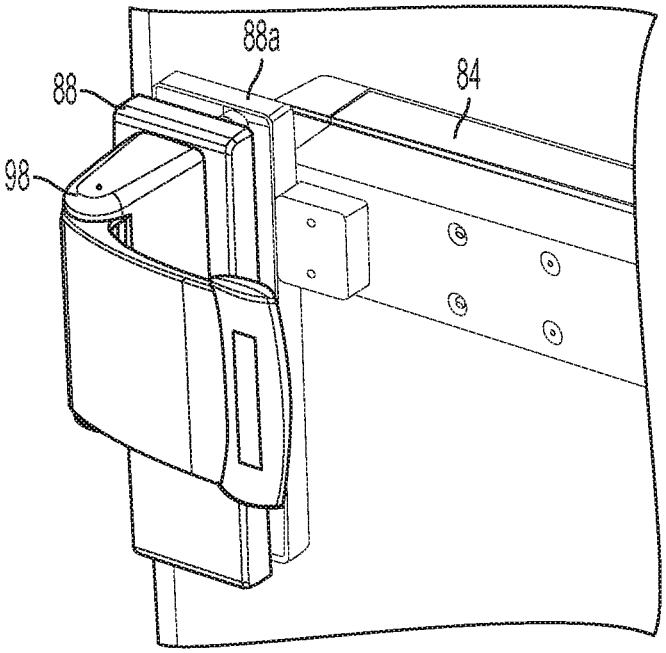
FIG. 14 is the exemplary embodiment of the door latch system with patch latch assembly including a push bar actuator and a latch paddle shown in FIG. 13 from the door interior.

With attention directed to FIGS. 5 and 6, in one aspect of the present invention, aperture 70 may be incorporated within a recess 72 defined within inner face 34. An insert 74 may then be secured within recess 72 so as to selectively modify the characteristics of aperture 70. To that end, insert 74 may include a plurality of threaded holes configured to receive mounting screws for securing a selected latch trim within patch latch assembly 22. As seen in FIGS. 5 and 6, screws 76, 76*a* may thread within respective holes 78, 78*a* on latch adapter plate 30 so as to identify, for example, specific mounting holes 80, 80*a*, and 80*b* for a selected article of trim, such as cylinder 18 shown in FIGS. 11 and 12 or push bar actuator 84 as shown in FIGS. 13 and 14. Aperture 70*b* may remain unmodified so as to receive an exit notifier 86 as shown in FIG. 12 or may be simply covered by cover plate 88, as will be described in greater detail below.

Figure 8:
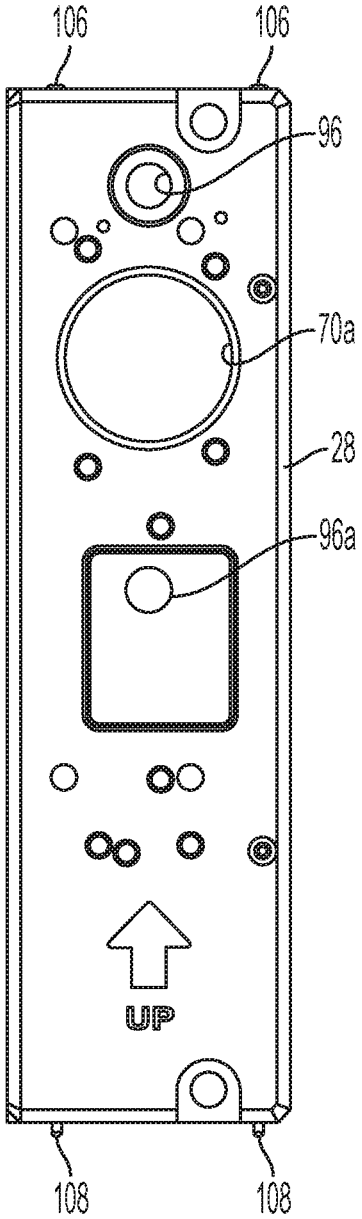
FIG. 8 is an exterior view of the patch latch adapter unit shown in FIG. 7.

Turning now to FIGS. 7 and 8, patch latch assembly 22 may be modified with one or more alternative inserts, such as inserts 90, 92. Similar to insert 74 described above, insert 90 may be received within recess 72 so as to modify aperture 70. Insert 92 may reside within a recess 94 defined in inner face 34 so as to modify the presentation of aperture 70*b*. In this manner, first latch adapter subunit 28 may be selectively modified to provide mounting features 96, 96*a* for mounting a user desired trim item, such as latch paddle 98 shown in FIGS. 12 and 13.

In one aspect of the present invention, aperture 70*a* is configured to receive actuating mechanism 16 for latch mechanism 12 (see FIG. 1) and is, therefore not modified by an insert.

Figure 9:
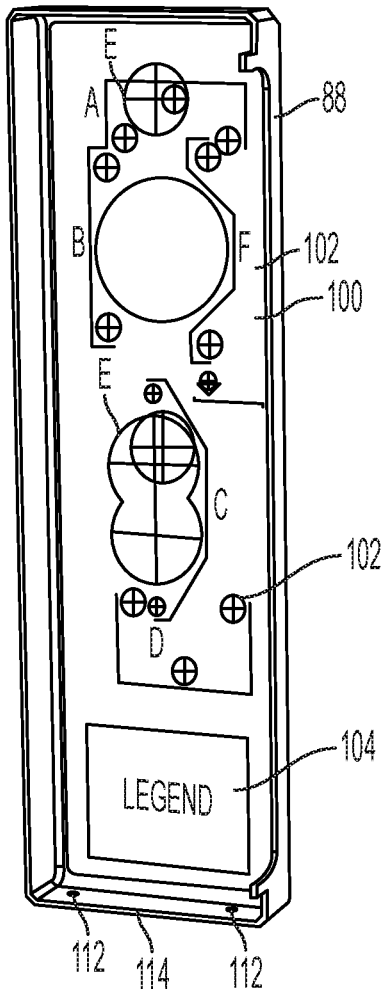
FIG. 9 is an interior view of a cover plate for use within the patch latch assembly shown in FIG. 1.

Returning to FIG. 1, and with additional reference to FIG. 9, patch latch assembly 22 may further include respective cover plates 88, 88*a* proportioned to encapsulate respective first and second latch adapter subunits 28, 28*a*. As shown in FIGS. 1 and 11-14, cover plates 88, 88*a* may be secured to latch adapter subunits 28, 28*a* through trim elements, such as cylinder 18 (FIGS. 1, 11 and 12), push bar actuator 84 (FIGS. 13 and 14), exit notifier 86 (FIG. 12) and/or latch paddle 98 (FIGS. 12-14).

To facilitate mounting of the various trim elements that be needed for a particular application, cover plates 88, 88*a* may be provided as universal cover plates that are customizable to be made compatible with various trim elements. As shown in FIG. 9, inner face 100 of cover plate 88 may include indicia 102 indicating the needed holes, and location and size of holes to be drilled through cover plate 88 for passage of the needed mounting hardware associated with particular trim elements (not shown). Indentations for drill points may also be formed to facilitate drilling operations. A legend 104 may also be included upon inner face 100 so as to further facilitate proper size and location of any required holes that need to be drilled to accommodate user-selected trim/hardware. It should be understood by those skilled in the art that FIG. 9 shows cover plate 88, but that cover plate 88*a* may be similarly marked and modified as appropriate and indicated. In this manner, a single pair of cover plates 88, 88*a* may be selectively modified at the factory or in the field so as to receive and mount one of a plurality of door latches and latch actuators. As such, fabrication and stocking of patch latch components may be reduced and simplified.

A method of forming a customized cover plate from a universal cover plate to make the customized cover plate compatible with a particular trim may include the steps of:

- providing a universal cover plate 88 or 88*a* with one or more undrilled holes needed to accommodate one of a plurality of trim elements associated with a user-selected lock application;
- providing indicia formed in cover plate 88 or 88*a* indicating the location of said two or more undrilled holes;
- providing information respecting which undrilled hole or holes are needed to be drilled to accommodate said user-selected lock application;
- forming said hole or holes in the provided locations based upon the provided information to form said customized cover plate.

It should be noted that information may be provided in the form of printed material or formed as indicia in the cover plate.

Figure 10:
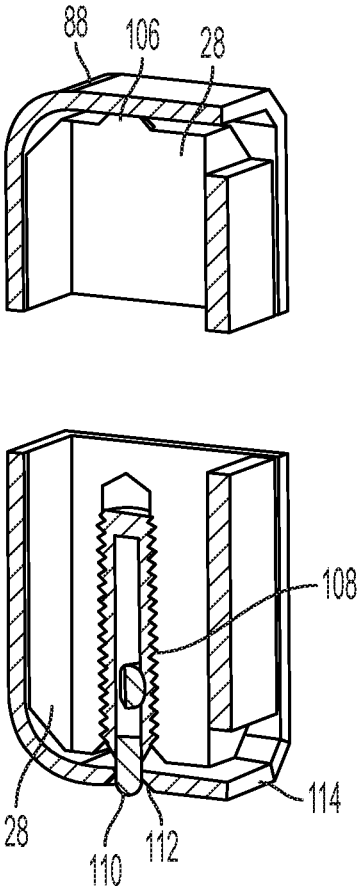
FIG. 10 is an expanded interior view of a patch latch adapter within the cover plate shown in FIG. 9.
Figure 11:
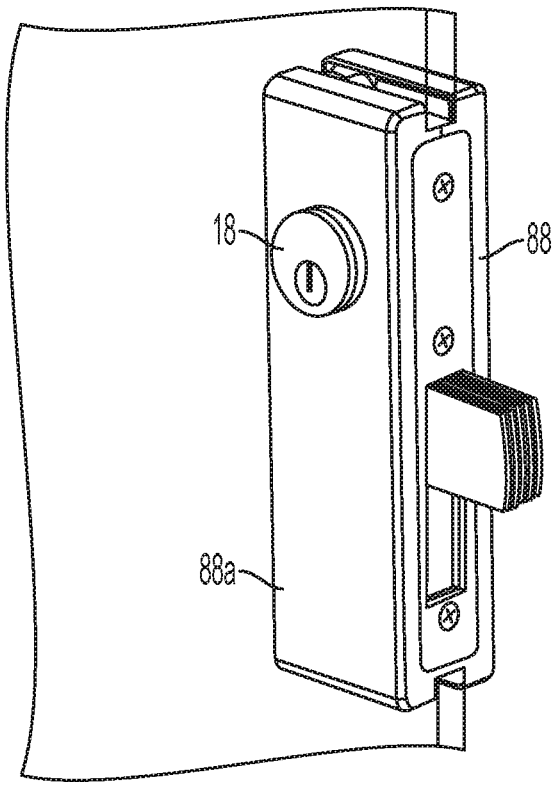
FIG. 11 is an exemplary embodiment of the door latch system with patch latch assembly including a lock cylinder and extended latch.

Turning now to FIGS. 9 and 10, cover plate 88 along with first and second latch adapter subunits 28 may include cover mounting elements to assist placement of cover plates 88. As seen in FIGS. 1-8, first and second latch adapter subunits 28, 28*a* may include positioning elements 106, 106*a* along the outer face of top sidewall 36, 36*a*. As shown in FIGS. 9 and 10, and with reference to FIGS. 6 and 8, first latch adapter subunit 28 may also include spring loaded plunger assembly 108 having one or more plungers 110 configured to reside within respective hole(s) 112 defined within bottom wall 114 of cover 88 when cover 88 is properly aligned with first latch adapter subunit 28. In this manner, cover 88 may be held in their proper place until the trim is mounted onto patch latch assembly 22 to secure the cover. Again, it should be understood by those skilled in the art that the above description applies equally to cover plate 88*a*.

Figure 15:
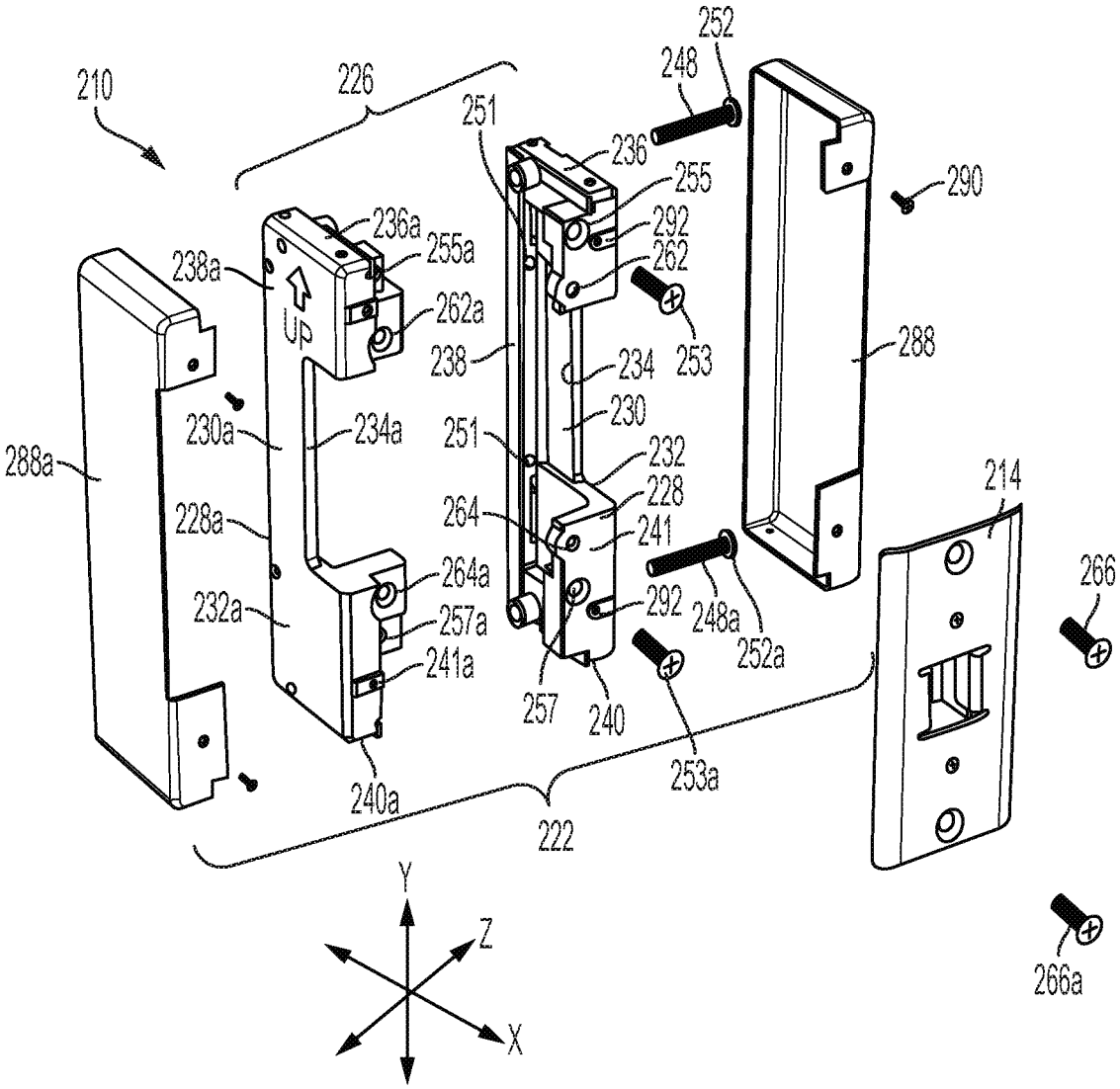
FIG. 15 is an exploded view of an embodiment of a patch lock assembly shown as a patch strike assembly in accordance with the present invention including an exemplary strike plate.
Figure 16:
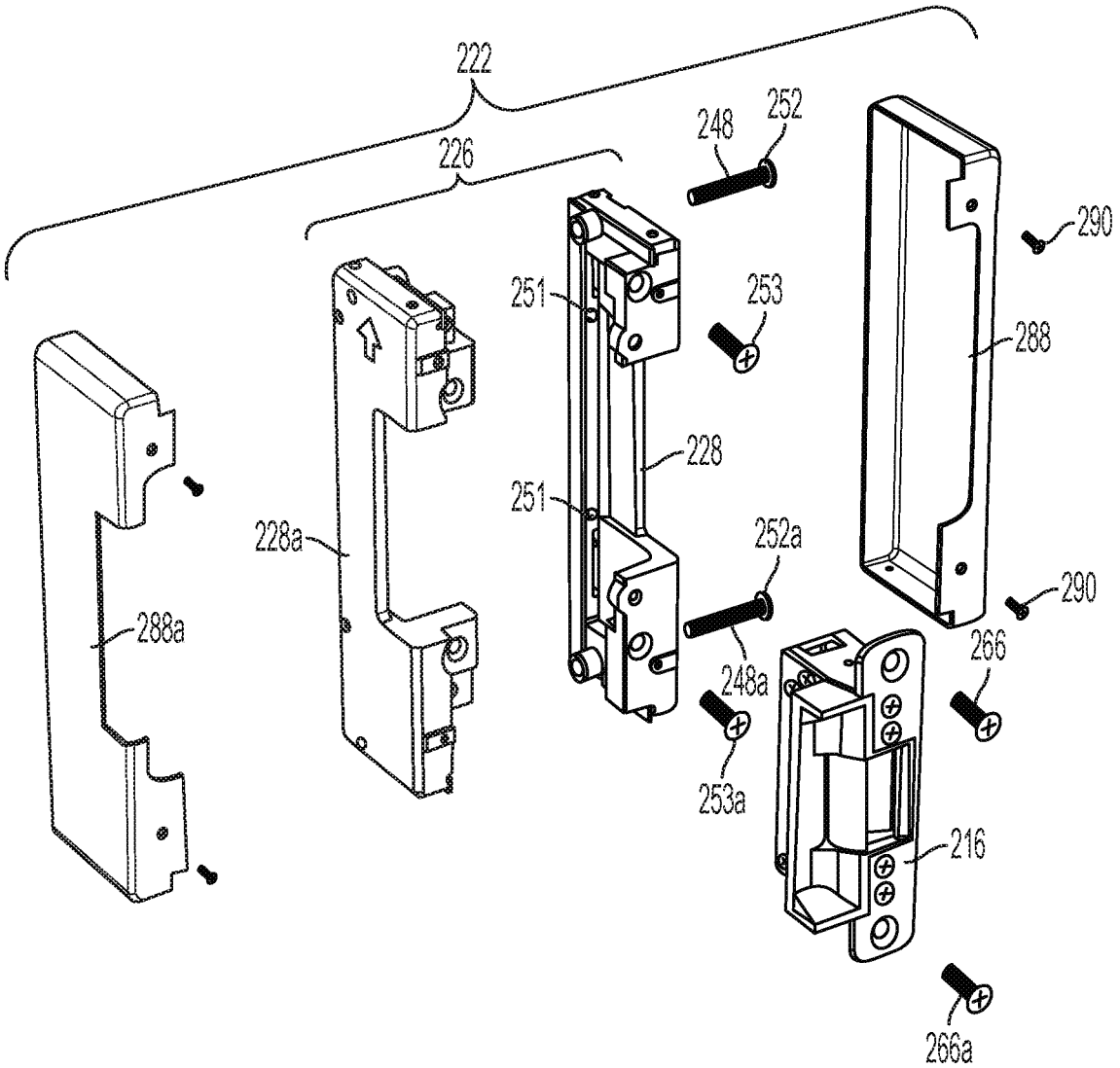
FIG. 16 is an exploded view of an embodiment of a door strike system with patch strike assembly in accordance with the present invention including an exemplary electric strike.

With reference to FIGS. 15-25, double glass door installations or glass panel wall installations having first glass door 20 and second glass panel 212 (see e.g., FIGS. 23 and 25), require a door strike system 210 having a strike, such as strike plate 214 shown in FIG. 15 or electric strike 216 shown in FIG. 16, configured to receive door latch 14 when door 20 is in the closed orientation and selectively release door latch 14 upon proper actuation of latch mechanism 12 as described above.

To that end door strike system 210 may generally include patch lock assembly such as patch strike assembly 222 having strike adapter housing 226 comprised of opposing first and second strike adapter subunits 228, 228*a*. First and second strike adapter subunits 228, 228*a* each comprises a strike adapter plate 230, 230*a* having a respective outer face 232, 232*a* and a respective inner face 234, 234*a*. A respective top sidewall 236, 236*a*, back sidewall 238, 238*a*, bottom sidewall 240, 240*a* and front sidewall 241, 241*a* extend perpendicularly outward from respective inner face 234, 234*a*. Top sidewall 236, back sidewall 238 and bottom sidewall 240 of first strike adapter subunit 228 are proportioned to bound a 3-sided recess defined within second glass panel 212 similar to recess 24 described above. Top sidewall 236, back sidewall 238 and bottom sidewall 240 may mount to the interior surface 242 of second glass panel 212 (see e.g., FIG. 23). Top sidewall 236*a*, back sidewall 238*a* and bottom sidewall 240*a* of second strike adapter subunit 228*a* are proportioned to bound the 3-sided recess on exterior surface 244 of second glass panel 212. First and second strike adapter subunits 228, 228*a* may thereby define a strike receiving cavity 246 therebetween (see e.g., FIG. 17).

Similar to first and second latch adapter subunits 28, 28*a* described above, first and second strike adapter subunits 228, 228*a* may be secured to one another (in the z-axis) through a first pair of fasteners, such as but not limited to screws 248, 248*a*. To that end, first latch adapter subunit 228 may include recesses 250, 250*a* (FIG. 17) configured to receive heads 252, 252*a* of screws 248, 248*a* such that outer face 232 maintains a flush surface. As described above with regard to door 20, the 3-sided recess of panel 212 may include notches formed in adjacent corners of the recess that are positioned to coincide with screws 248/248*a*. In this manner, the notches may provide an interference with screws 248, 248*a* should external attempts be made to remove, disable or destroy door strike system 210. As a result, movement of patch strike assembly 222 is restricted in all three ordinal directions x, y, z, when mounted onto door 20.

To provide additional structural integrity to strike adapter housing 226, front sidewalls 241, 241*a* of first and second strike adapter subunits 228, 228*a* may be secured to one another (in the x-axis) through a second pair of fasteners, such as but not limited to screws 253, 253*a* threaded into mating bores 255/255*a* and 257/257*a* defined in strike adapter subunits 228, 228*a*. Additionally, front sidewalls 241, 241*a* may further define a respective bore 262, 262*a*, 264, 264*a* such that paired bores 262/264 and 262*a*/264*a* align with one another. Aligned bores 262/264 and 262*a*/264*a* may then receive a respective mounting screw 266, 266*a* used to secure strike plate 214 or electric strike 216 to patch strike assembly 222 (see FIGS. 15 and 16), such as along the x-axis.

Thus, in accordance with the invention, one or more interlocking features may be incorporated into door strike system 210 to secure patch strike assembly 222 to glass panel door 20 including one or more of the following interlocking features:

- Notches similar to 54, 54*a* to secure the patch strike assembly in the x direction;
- Fasteners 248, 248*a* to secure the patch strike assembly in the z direction;
- Opposing sides of recess 24 to secure the patch strike assembly in the y direction;
- Aligned bores 255/255*a*, 257/257*a*, 262/264, 262*a*/264*a* in respective strike adapter subunits 228, 228*a* for receiving fasteners to oppose relative movement of the subunits in the x direction.

Figure 17:
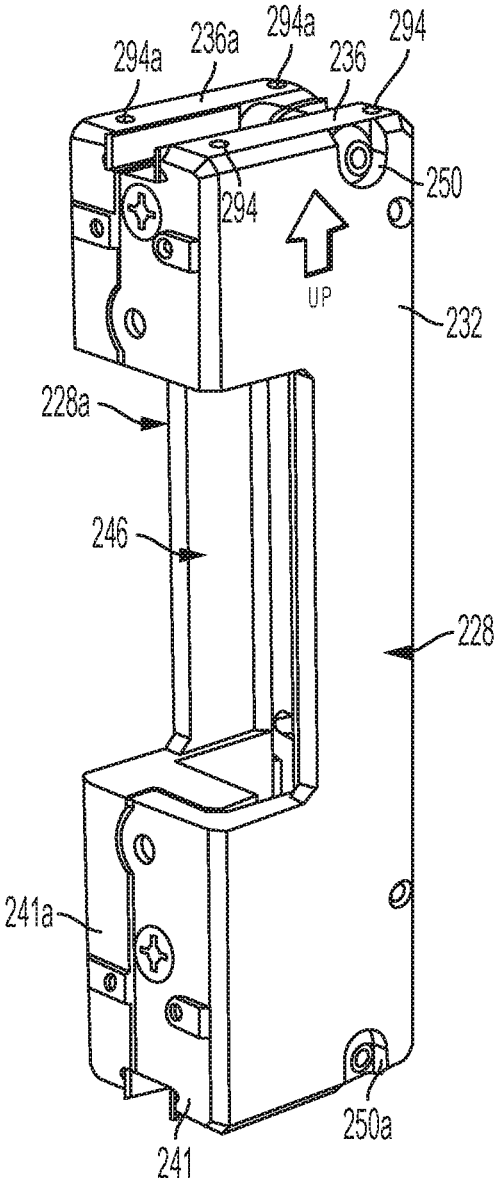
FIG. 17 is a perspective view of an assembled patch strike adapter subunit.
Figure 18:
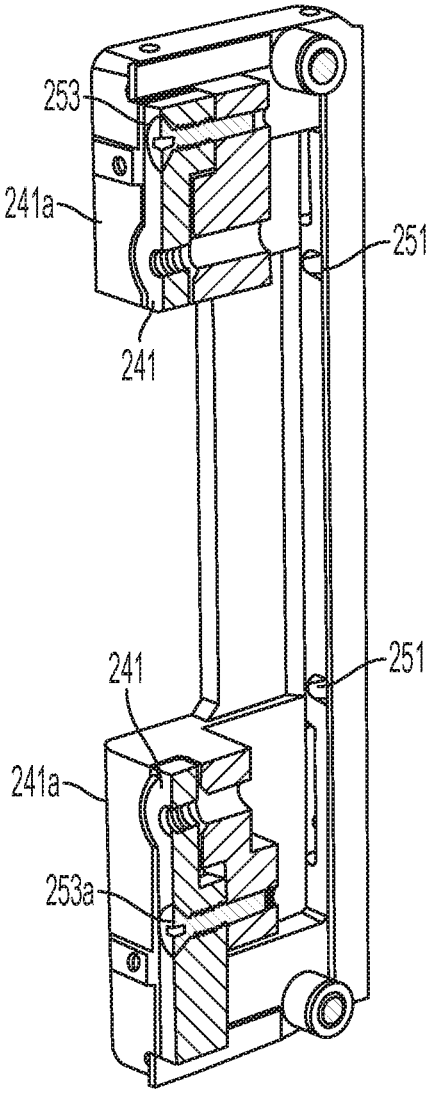
FIG. 18 is a cross section view of the patch strike adapter subunit shown in FIG. 17.

As shown in FIGS. 15 and 16, patch strike assembly 222 may further include respective cover plates 288, 288*a* proportioned to encapsulate respective first and second strike adapter subunits 228, 228*a*. Strike adapter cover plates 288, 288*a* may be secured to their respective strike adapter subunits 228, 228*a* via cover plate mounting screws 290 secured within threaded holes 292 on front sidewalls 241, 241*a*. Similar to latch adapter covers 88, 88*a* and first and second latch adapter subunits 28, 28*a* described above, strike adapter cover plates 288, 288*a* and strike adapter subunits 228, 228*a* may include cover mounting elements to assist placement of cover plates 288, 288*a*. As seen in FIGS. 17 and 18, first and second strike adapter subunits 228, 228*a* may include positioning elements 294, 294*a* along the outer face of top sidewall 236, 236*a* similar to first and second latch adapter subunits 28, 28*a* described above. First and second strike adapter subunits 228, 228*a* may also include one or more spring loaded plunger assemblies (not shown—but se FIG. 10) having one or more plungers configured to reside within respective holes defined within the bottom wall of the cover plate when the cover plate is properly aligned with first and second strike adapter subunits 228, 228*a*. In this manner, cover plates 288, 288*a* may be held in their proper places when securing mounting screws 290.

Turning now to FIGS. 19-25, in accordance with another aspect of the present invention, door latch system 10 and door strike system 210 may be configured to include electrical components, such as but not limited to powered latch actuators and electric strikes, such as that disclosed within U.S. application Ser. No. 15/098,041, the entirety of which is hereby incorporated by reference.

Figure 19:
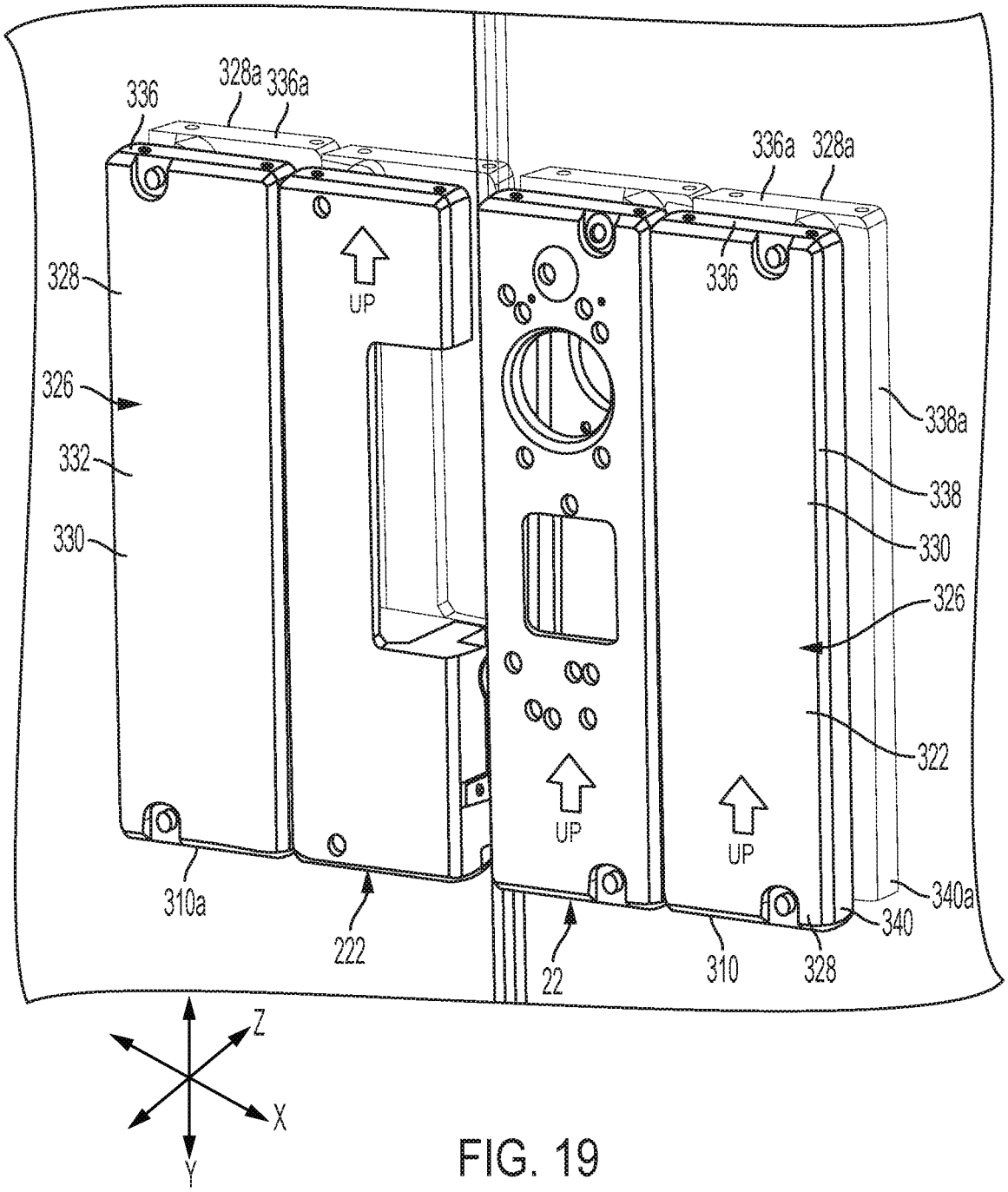
FIG. 19 is a front perspective view of an embodiment of a door latch system with a patch lock assembly in accordance with the present invention including a patch latch adapter housing, a patch strike adapter housing and associated power supply and control module units.
Figure 20:
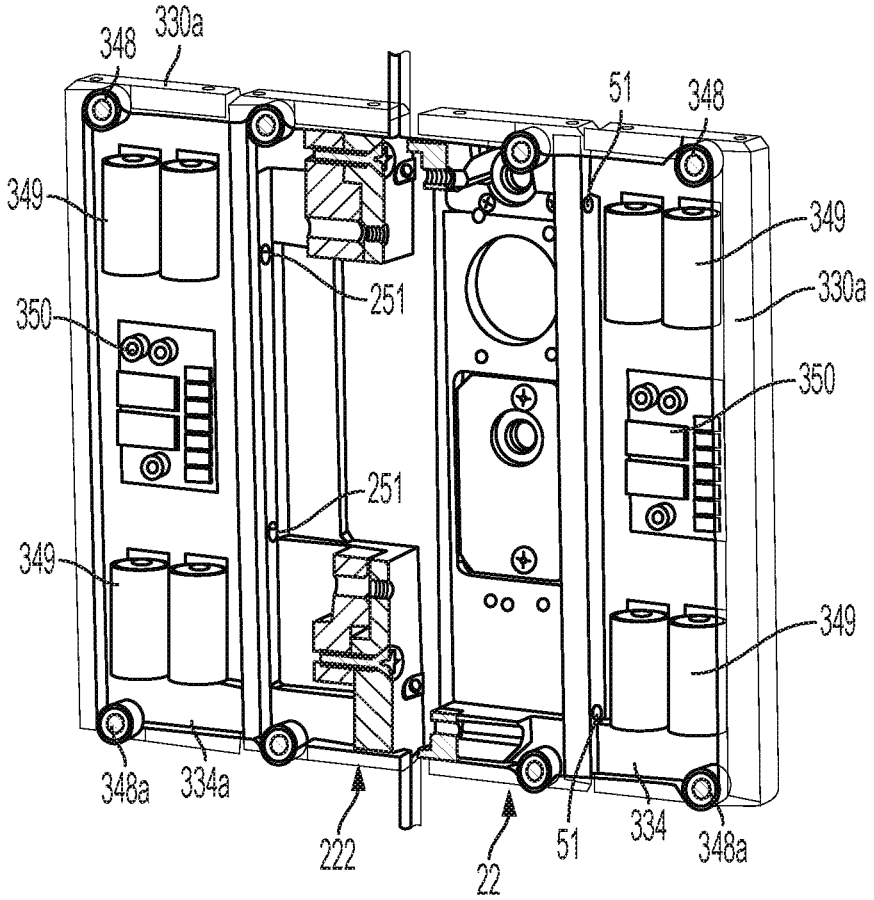
FIG. 20 is a cross section view of the door latch system shown in FIG. 19.

As shown in FIGS. 19 and 20, when incorporating an electrified latch and/or strike system, patch latch assembly 22 and/or patch strike assembly 222 may further include a respective power supply and control modules 310, 310*a* mounted immediately adjacent assemblies 22, 222. Power supply and control module 310, 310*a* may each generally include power supply housing 326 comprised of opposing first and second power supply adapter subunits 328, 328*a*. First and second power supply adapter subunits 328, 328*a* comprise respective power supply adapter plates 330, 330*a* having a respective outer face 332, 332*a* and a respective inner face 334, 334*a*. A respective top sidewall 336, 336*a*, back sidewall 338, 338*a* and bottom sidewall 340, 340*a* extend perpendicularly outward from respective inner face 334, 334*a* similar to that shown in FIG. 15. Top sidewall 336, back sidewall 338 and bottom sidewall 340 of first power supply adapter subunit 328, in combination with first latch adapter subunit 28/first strike adapter subunit 228, are proportioned to bound 3-sided duplex recess 324 defined within glass door 20/second glass panel 212 (see FIG. 21).

Figure 21:
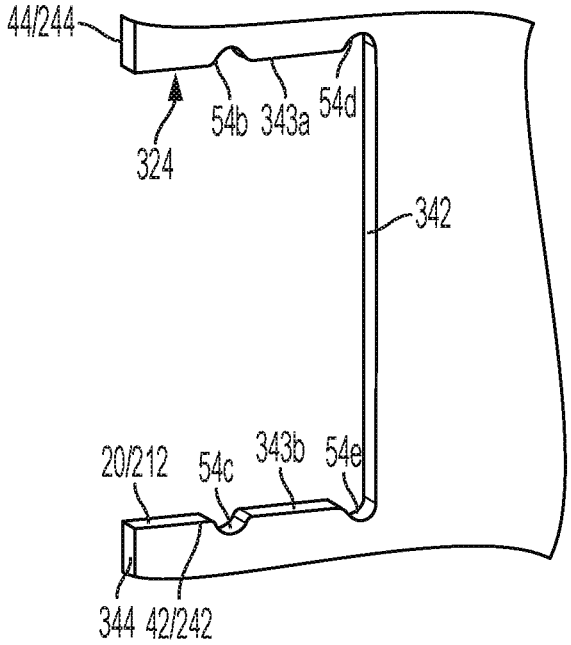
FIG. 21 is an exemplary view of a glass door recess for use with the door latch system shown in FIG. 19.

Referring to FIGS. 19-21, top sidewall 336, back sidewall 338 and bottom sidewall 340 may mount to the first surface 42 of door 20/first surface 242 of second glass panel 212. Top sidewall 336*a*, back sidewall 338*a* and bottom sidewall 340*a* of second power supply adapter subunit 328*a*, in combination with second latch adapter subunit 28*a*/second strike adapter subunit 228*a*, are proportioned to bound recess 324 on second surface 44 of door 20/second surface 244 of second glass panel 212. First and second power supply adapter subunits 328, 328*a* may thereby define a power supply and control module receiving cavity 346 therebetween when secured by one another via button head screws 348, 348*a* (see e.g., FIGS. 23 and 25). As shown in FIG. 21, door 20 or glass panel 212 may each be configured to define duplex recess 324 wherein duplex recess 324 includes back edge 342 and side edges 343,343*a* connecting back edge 342 to front edge 344 of the glass panel/door. Recess 324 defines two pairs of notches 54*b*/54*c* and 54*d*/54*e* wherein notches 54*d*/54*e* are disposed at the junction between back edge 342 and respective side edges 343*a* and 343*b*, and notched 54*b*, 54*c* are disposed on respective side edges midway between back edge 342 and door front edge 344. Notches 54*b*/54*c* are configured to receive screws 48/48*a*, 248/248*a* for respective patch latch assembly 22, patch strike assembly 222 as described above. Notches 54*d*/54*e* may be configured to receive screws 348, 348*a* of power supply and control module 310.

As shown in FIG. 20, power supply and control modules 310, 310*a* may include one or more batteries 349 and control unit 350 within power supply and control module receiving cavity 346. Batteries 349 may then selectively power electric latch 352 and/or electric strike 216 (FIG. 25) under operational control of control unit 350. To that end, back sidewalls 38, 38*a* of first and second latch adapter subunits 28, 28*a* and back sidewalls 238, 238*a* of first and second strike adapter subunits 228, 228*a* each include one or more respective wire feed holes 51, 251. In this manner, wire (not shown) may be fed through wire feed holes 51 and 251 so as to enable delivery of power from batteries 349 to appropriate loads within door latch system 10 and/or door strike system 210.

Figure 22:
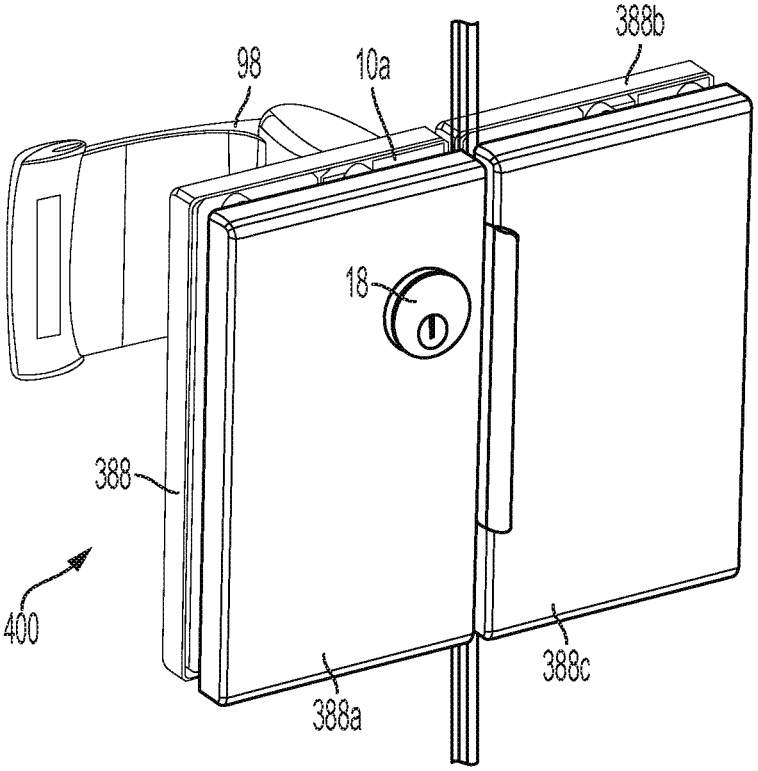
FIG. 22 is a perspective view of an exemplary door latch system including a lock cylinder, a manual actuated paddle, unpowered strike plate and associated power supply and control module units.
Figure 23:
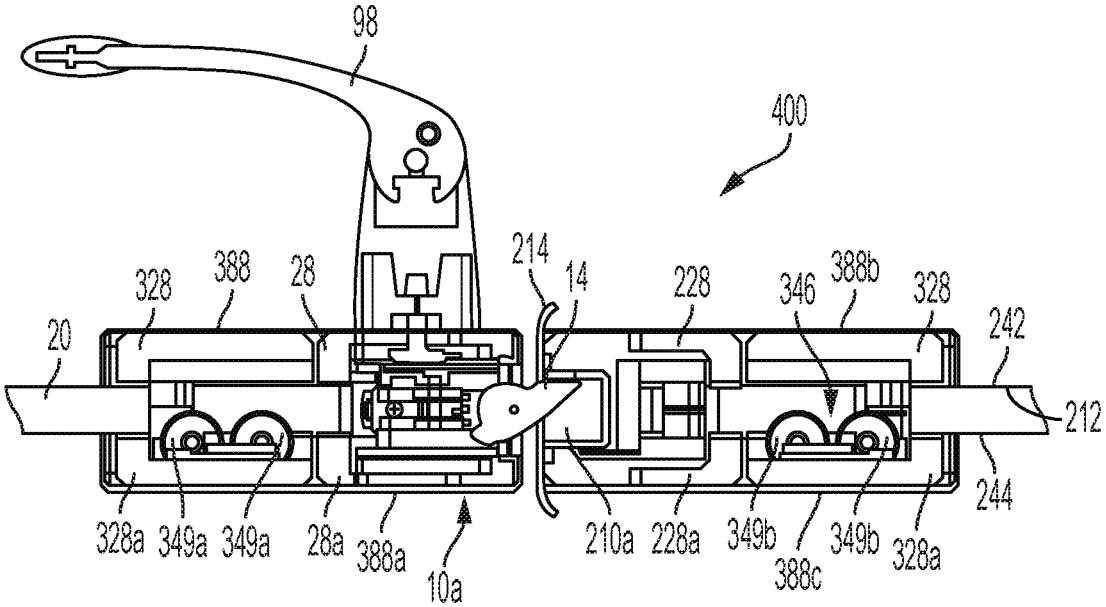
FIG. 23 is a top cross section view of the exemplary door latch system shown in FIG. 22.

By way of example and without limitation thereto, FIGS. 22 and 23 illustrate an exemplary double glass door installation 400 including an electrified door latch system 10*a* wherein latch 14 may be electrically actuated via latch batteries 349*a* but also includes a manual actuated paddle 98 and manually actuated cylinder 18. The opposing door strike system 210*a* may include strike plate 214 which is unpowered. Batteries 349*b* may be optionally provided in opposing door strike system 210*a* to power auxiliary features such as buzzers, LEDs of information displays. In a further non-limiting example shown in FIGS. 24 and 25, a second double glass door installation 410 may also include an electrified door latch system 10*a* similar to that shown and described with regard to FIGS. 22 and 23, and also include an opposing door strike system 210*b* that includes electric strike 216 configured to be electrically actuated via strike batteries 349*b*.

Figure 24:
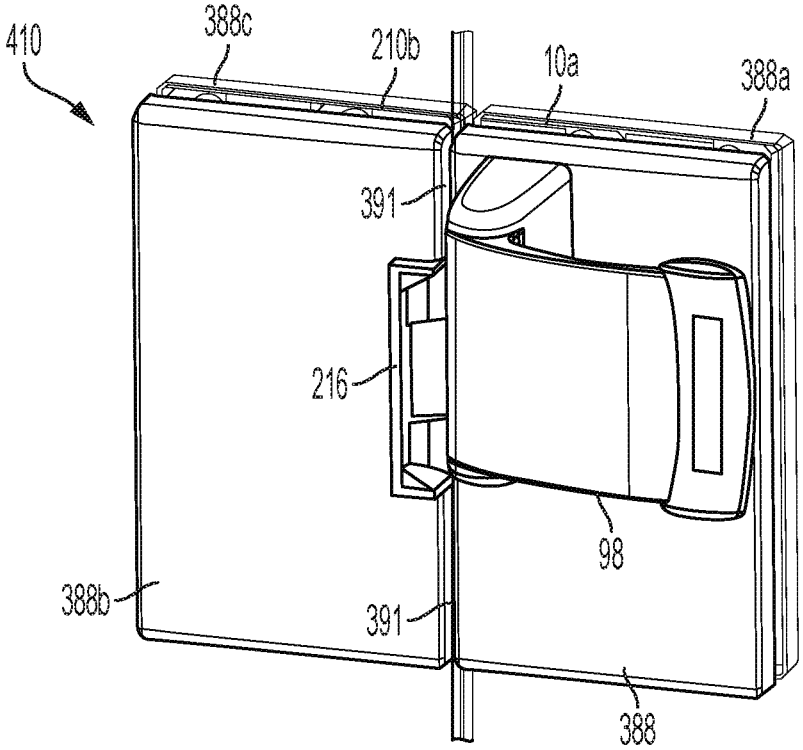
FIG. 24 is a perspective view of an exemplary door latch system including a manual actuated paddle and powered electric strike and associated power supply and control module units.
Figure 25:
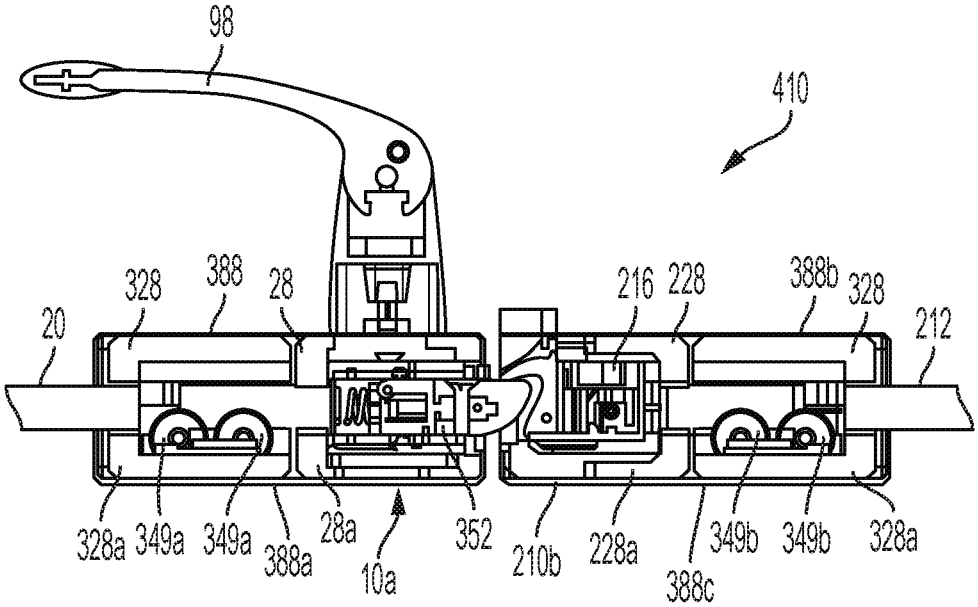
FIG. 25 is a top cross section view of the exemplary door latch system shown in FIG. 24.

As shown in FIGS. 22 and 24, the duplexed-power supply and control module 310 may include duplex covers 388, 388*a* while the power supply and control module 310*a* include duplex covers 388*b*, 388*c*. Duplex covers 388, 388*a*, 388*b*, 388*c* may also include indicia and legends are described above with regard to cover 88, 88*a* so as to facilitate placement and proper size of any holes drilled within covers 388, 388*a*, 388*b*, 388*c*. Also, similar to covers 88, 88*a*, cover 388, 388*a* may be held in place with trim (such as mortise cylinder 18) while covers 388*b* and 388*c* may be secured via screws 391 (see FIG. 24).

It should be noted that FIGS. 22-25 are limited examples illustrating the modularity, interchangeability and flexibility afforded by the present invention. One skilled in the art should readily understand that the above examples may be modified or changed so as to accommodate any appropriate latch system and/or strike system, and that such modifications are to be considered within the teachings of the present disclosure.

Furthermore, while the invention has been described by reference to various specific embodiments, it should be understood that numerous changes may be made within the spirit and scope of the inventive concepts described. Accordingly, it is intended that the invention not be limited to the described embodiments, but will have full scope defined by the language of the following claims.

What is claimed is:

1. A patch lock assembly for use in a door latch system, the patch lock assembly being securable to a door, wherein the door defines a recess, the patch lock assembly comprising:

an adapter housing having a first adapter subunit and a second adapter subunit, wherein when said patch lock assembly is secured to said door, said first adapter subunit is disposed on a first surface of said door and said second adapter unit is disposed on a second surface of said door opposite said first surface, wherein said door recess, said first adapter subunit and said second adapter subunit define a cavity for receiving one of a latch mechanism or a strike therein; and at least one interlocking feature configured to inhibit translation of the patch lock assembly relative to said door in one of an x, y or z direction, wherein said at least one interlocking feature includes a first notch defined by said recess, wherein said first adapter subunit is connected to said second adapter subunit by a first fastener to secure said patch lock assembly to said door, and wherein said first fastener interferes with said first notch defined by said recess to inhibit translation of said patch lock assembly relative to said door in said x direction.

2. The patch lock assembly in accordance with claim 1 wherein said interlocking feature includes a second notch defined by said recess, wherein said patch lock assembly includes a second fastener to secure said patch lock assembly to said door, and wherein said first and second fasteners interfere with respective first and second notches to inhibit translation of said patch lock assembly relative to said door in said x direction.

3. The patch lock assembly in accordance with claim 1 wherein said first adapter subunit comprises an outer face, an inner face and a top sidewall, a back sidewall and a bottom sidewall, wherein each of said top sidewall, said back sidewall and said bottom sidewall of said first adapter subunit extend perpendicularly outward from said inner face of said first adapter subunit, wherein each of said top sidewall, said back sidewall and said bottom sidewall of said first adapter subunit are configured to engage said first surface of the door when said first adapter subunit is mounted on the door, wherein said second adapter subunit comprises an outer face, an inner face and a top sidewall, a back sidewall and a bottom sidewall, wherein each of said top sidewall, said back sidewall and said bottom sidewall of said second adapter subunit extend perpendicularly outward from said inner face of said second adapter subunit, wherein each of said top sidewall, said back sidewall and said bottom sidewall of said first adapter subunit are configured to engage said second surface of the door when said second adapter subunit is mounted on the door, and wherein said top and bottom sidewalls of said first and second adapter subunits further include respective sidewall mating surfaces extending perpendicularly outward from each respective said inner face, wherein said respective sidewall mating surface includes complementary locking stepped profiles configured to engage one another when said first adapter subunit and said second adapter subunit are mounted on the door.

4. The patch lock assembly in accordance with claim 3 further comprising:

a) a first fastener securing said first adapter subunit to said second adapter subunit proximate a junction of said top sidewall and said back sidewall of said first adapter subunit; and b) a second fastener securing said first adapter subunit to said second adapter subunit proximate a junction of said bottom sidewall and said back sidewall of said first adapter subunit.

5. The patch lock assembly in accordance with claim 1 wherein each of said first and second adapter subunits includes a plurality of apertures, the patch lock assembly further including a plurality of inserts, each respective said insert selectively mountable on a respective said first or second adapter subunit within a respective aperture, each said insert configured to thereby modify said respective first or second adapter subunit to receive said latch mechanism selected from one of a plurality of door latches and door latch actuators.

6. The patch lock assembly in accordance with claim 1 further including a first cover plate secured to said first adapter subunit and a second cover plate secured to said second adapter subunit, wherein an inner face of at least one of said first and second cover plates include indicia configured to provide customized fabrication information depending on the particular patch lock assembly application.

7. The patch lock assembly in accordance with claim 6 wherein said customized fabrication information includes drill size and hole location.

8. A patch lock assembly for use in a door latch system, the patch lock assembly being securable to a door, wherein the door defining a recess for receiving said patch lock assembly, the patch lock assembly comprising:

i) an adapter housing having a first adapter subunit and a second adapter subunit, wherein when said patch lock assembly is secured to said door, said first adapter subunit is disposed on a first surface of said door and said second adapter unit is disposed on a second surface of said door opposite said first surface;

ii) at least one interlocking feature configured to inhibit translation of the patch lock assembly relative to said door in one of an x, y or z direction, wherein said at least one interlocking feature is a first notch defined by said recess, wherein said first adapter subunit is connected to said second adapter subunit by a first fastener to secure said patch lock assembly to said door, and wherein said first fastener interferes with said first notch defined by said recess to inhibit translation of said patch lock assembly relative to said door in said x direction;

iii) a third adapter subunit mounted adjacent to the first adapter subunit, the third adapter subunit having an outer face, an inner face and a top sidewall, back sidewall and bottom sidewall extending perpendicularly outward from the inner face, each sidewall being configured to engage said first surface of the door when the third adapter subunit is mounted on the door; and iv) a fourth adapter subunit mounted adjacent to the second adapter subunit, the fourth adapter subunit having an outer face, an inner face and a top sidewall, back sidewall and bottom sidewall extending perpendicularly outward from the inner face, each sidewall being configured to engage said second surface of the door when the fourth adapter subunit is mounted on the door, wherein the first and third adapter subunits and the second and fourth adapter subunits bound the recess whereby the first and second adapter subunits define the door latch receiving cavity therebetween and the third and fourth adapter subunits define a door latch electronics receiving cavity therebetween.

9. The patch lock assembly in accordance with claim 8 wherein electronics received in said electronics receiving cavity include a power supply and/or a control module.

10. A patch lock assembly for releasably securing a first door in a locked orientation to an adjacent glass panel, the patch lock assembly comprising:

a) an adapter housing including:

i) a first strike adapter subunit having an outer face, an inner face and a top sidewall, a front sidewall, a back sidewall and a bottom sidewall, wherein each of said top sidewall, said back sidewall and said bottom sidewall of said first adapter subunit extend perpendicularly outward from said inner face of said first adapter subunit, wherein each of said top sidewall, said back sidewall and said bottom sidewall of said first adapter subunit are configured to engage a first surface of the glass panel, ii) a second strike adapter subunit having an outer face, an inner face and a top sidewall, a front sidewall, a back sidewall and a bottom sidewall, wherein each of said top sidewall, said back sidewall and said bottom sidewall of said second adapter subunit extend perpendicularly outward from said inner face of said second adapter subunit, wherein each of said top sidewall, said back sidewall and said bottom sidewall of said second adapter subunit are configured to engage a second surface of the glass panel, wherein said first strike adapter subunit and said second strike adapter subunit define a cavity including a first portion of a recess defined within the glass panel, wherein said cavity is configured for receiving one of a latch mechanism or a strike therein, wherein said cavity is configured to coincide with an edge of the glass panel;

b) a first fastener securing said first adapter subunit to said second adapter subunit proximate a junction of said top sidewall and said back sidewall of said first and second adapter subunits; and c) a second fastener securing said first adapter subunit to said second adapter subunit proximate a junction of said bottom sidewall and said back sidewall of said first and second adapter subunits.

11. A patch lock system for releasably securing a first door in a locked orientation to an adjacent glass panel, the patch lock system comprising:

a) a latch adapter housing including:

i) a first latch adapter subunit having an outer face, an inner face and a top sidewall, a back sidewall and a bottom sidewall, wherein each of said top sidewall, said back sidewall and said bottom sidewall of said first latch adapter subunit extend perpendicularly outward from said inner face of said first latch adapter subunit, wherein each of said top sidewall, said back sidewall and said bottom sidewall of said first latch adapter subunit are configured to engage a first surface of the first door, ii) a second latch adapter subunit having an outer face, an inner face and a top sidewall, a back sidewall and a bottom sidewall, wherein each of said top sidewall, said back sidewall and said bottom sidewall of said second latch adapter subunit extend perpendicularly outward from said inner face of said second latch adapter subunit, wherein each of said top sidewall, said back sidewall and said bottom sidewall of said second latch adapter subunit are configured to engage a second surface of the first door, wherein said first latch adapter subunit and said second latch adapter subunit define a first cavity including a first portion of a first recess defined within the first door for receiving a door latch, wherein said first cavity is configured to coincide with an edge of the first door, wherein said top and bottom sidewalls of said first and second latch adapter subunits further include respective sidewall mating surfaces extending perpendicularly outward from each respective inner face of said first and second latch adapter subunits, wherein said respective sidewall mating surfaces include complementary locking stepped profiles configured to engage one another when said first latch adapter subunit and said second latch adapter subunit are mounted on the first door;

b) a strike adapter housing including:

i) a first strike adapter subunit having an outer face, an inner face and a top sidewall, a front sidewall, a back sidewall and a bottom sidewall, wherein each of said top sidewall, said back sidewall and said bottom sidewall of said first strike adapter subunit extend perpendicularly outward from said inner face of said first strike adapter subunit, wherein each of said top sidewall, said back sidewall and said bottom sidewall of said first strike adapter subunit are configured to engage a first surface of the glass panel, ii) a second strike adapter subunit having an outer face, an inner face and a top sidewall, a front sidewall, a back sidewall and a bottom sidewall, wherein each of said top sidewall, said back sidewall and said bottom sidewall of said second strike adapter subunit extend perpendicularly outward from said inner face, said top sidewall, said back sidewall and said bottom sidewall of said second strike adapter subunit, wherein each of said top sidewall, said back sidewall and said bottom sidewall of said second strike adapter subunit are configured to engage a second surface of the glass panel, wherein said first strike adapter subunit and said second strike adapter subunit define a second cavity including a first portion of a second recess defined within the glass panel for receiving a door strike, wherein said second cavity is configured to coincide with an edge of the glass panel opposite said first cavity.

12. A patch lock system for releasably securing a first door in a locked orientation to an adjacent glass panel, the patch lock system comprising:

a) a latch adapter housing including:

i) a first latch adapter subunit having an outer face, an inner face and a top sidewall, a back sidewall and a bottom sidewall, wherein each of said top sidewall, said back sidewall and said bottom sidewall of said first latch adapter subunit extend perpendicularly outward from said inner face of said first latch adapter subunit, wherein each of said top sidewall, said back sidewall and said bottom sidewall of said first latch adapter subunit are configured to engage a first surface of the first door, ii) a second latch adapter subunit having an outer face, an inner face and a top sidewall, a back sidewall and a bottom sidewall, wherein each of said top sidewall, said back sidewall and said bottom sidewall of said second latch adapter subunit extend perpendicularly outward from said inner face of said second latch adapter subunit, wherein each of said top sidewall, said back sidewall and said bottom sidewall of said second latch adapter subunit being configured to engage a second surface of the first door, wherein said first latch adapter subunit and said second latch adapter subunit are each configured to bound a first portion of a first recess defined within the first door to thereby define a door latch receiving cavity therebetween, wherein said door latch receiving cavity is configured to coincide with an edge of the first door, wherein said top and bottom sidewalls of said first and second latch adapter subunits further include respective sidewall mating surfaces extending perpendicularly outward from each respective inner face of said first and second latch adapter subunits, said respective sidewall mating surfaces having complementary locking stepped profiles configured to engage one another when said first latch adapter subunit and said second latch adapter subunit are mounted on the first door;

b) a strike adapter housing including:

i) a first strike adapter subunit having an outer face, an inner face and a top sidewall, a front sidewall, a back sidewall and a bottom sidewall, wherein each of said top sidewall, said back sidewall and said bottom sidewall of said first strike adapter subunit extend perpendicularly outward from said inner face of said first strike adapter subunit, wherein each of said top, said back sidewall and said bottom sidewall of said first strike adapter subunit are configured to engage a first surface of the glass panel, ii) a second strike adapter subunit having an outer face, an inner face and a top sidewall, a front sidewall, a back sidewall and a bottom sidewall extending perpendicularly outward from said inner face, said top sidewall, said back sidewall and said bottom sidewall of said second strike adapter subunit, each of said top sidewall, said back sidewall and said bottom sidewall of said second strike adapter subunit being configured to engage a second surface of the glass panel, wherein said first strike adapter subunit and said second strike adapter subunit are each configured to bound a first portion of a second recess defined within the glass panel for receiving a door strike, wherein said door strike receiving cavity is configured to coincide with an edge of the glass panel opposite the door latch receiving cavity c) a first power supply adapter housing coupled adjacent to said latch adapter housing, said first power supply adapter housing including:

i) a first power supply adapter subunit having an outer face, an inner face and a top sidewall, a back sidewall and a bottom sidewall, wherein each of said top sidewall, said back sidewall and said bottom sidewall of said first power supply adapter subunit extend perpendicularly outward from said inner face of said first power supply adapter subunit, ii) a second power supply adapter subunit having an outer face, an inner face and a top sidewall, a back sidewall and a bottom sidewall, wherein each of said top sidewall, said back sidewall and said bottom sidewall of said second power supply adapter subunit extend perpendicularly outward from said inner face of said second power supply adapter subunit, wherein said first power supply adapter subunit and said second power adapter subunit are each configured to bound a second portion of said first recess defined within the first door to thereby define a first power supply receiving cavity therebetween configured to receive a first power supply and a second control unit; and d) a second power supply adapter housing coupled adjacent to said strike adapter housing, said second power supply adapter housing including:

i) a third power supply adapter subunit having an outer face, an inner face and a top sidewall, a back sidewall and a bottom sidewall, wherein each of said top sidewall, said back sidewall and said bottom sidewall of said third power supply adapter subunit extend perpendicularly outward from said inner face of said third power supply adapter subunit, ii) a fourth power supply adapter subunit having an outer face, an inner face and a top sidewall, a back sidewall and a bottom sidewall, wherein each of said top sidewall, said back sidewall and said bottom sidewall of said fourth power supply adapter subunit extend perpendicularly outward from said inner face of said fourth power supply adapter subunit, wherein said third power supply adapter subunit and said fourth power adapter subunit are each configured to bound a second portion of said second recess defined within the glass panel to thereby define a second power supply receiving cavity therebetween configured to receive a second power supply and a second control unit.

13. The patch lock assembly in accordance with claim 12 wherein the glass panel is a second door.

14. For a lock assembly, a method of forming a customized cover plate from a universal cover plate to make the customized cover plate compatible with a particular trim associated with the lock assembly for a door comprising the steps of:

a) providing an adapter housing having a first adapter subunit and a second adapter subunit configured to be secured to said door, wherein said first adapter subunit is configured for being disposed on a first surface of said door and said second adapter unit is configured for being disposed on a second surface of said door opposite said first surface, and wherein said first adapter subunit and said second adapter subunit define a cavity therebetween;

b) providing a universal cover plate with two or more undrilled holes needed to accommodate one of a plurality of trim elements associated with a user-selected lock application to be disposed in said cavity, c) providing indicia formed in said universal cover plate indicating the location of said two or more undrilled holes, d) providing information respecting which undrilled hole or holes are needed to be drilled to accommodate said user-selected lock application, e) forming said hole or holes in the provided locations based upon the provided information to form said customized cover plate, and f) covering one of said first adapter subunit or said second adapter subunit with said customized cover plate.

15. The method in accordance with claim 14 wherein said provided information is formed as indicia in said universal cover plate.

* * * * *